US011814985B2

(12) United States Patent
Song et al.

(10) Patent No.: US 11,814,985 B2
(45) Date of Patent: Nov. 14, 2023

(54) TURBINE BLADE, AND TURBINE AND GAS TURBINE INCLUDING THE SAME

(71) Applicant: DOOSAN ENERBILITY CO., LTD., Changwon-si (KR)

(72) Inventors: Jin Woo Song, Changwon (KR); Jin Ho Bae, Gimhae (KR); Ki Baek Kim, Yongin (KR); Sung Chul Jung, Daejeon (KR); Jae Yeon Choi, Busan (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/932,214

(22) Filed: Sep. 14, 2022

(65) Prior Publication Data

US 2023/0167744 A1 Jun. 1, 2023

(30) Foreign Application Priority Data

Nov. 30, 2021 (KR) ..... 10-2021-0169167

(51) Int. Cl.
*F01D 5/30* (2006.01)

(52) U.S. Cl.
CPC ..... *F01D 5/3007* (2013.01); *F05D 2240/80* (2013.01); *F05D 2250/294* (2013.01); *F05D 2260/36* (2013.01)

(58) Field of Classification Search
CPC ..... F01D 5/30; F01D 5/3007; F01D 5/3015; F01D 5/12; F01D 5/14; F05D 2240/80; F05D 2250/294
See application file for complete search history.

(56) References Cited

U.S. PATENT DOCUMENTS

| | | | | |
|---|---|---|---|---|
| 3,501,249 | A * | 3/1970 | Scalzo | F01D 5/081 416/193 A |
| 3,572,966 | A * | 3/1971 | Borden | F01D 5/081 415/177 |
| 3,709,631 | A * | 1/1973 | Karstensen | F01D 11/006 416/193 A |
| 5,415,526 | A * | 5/1995 | Mercadante | F01D 11/006 416/193 A |
| 5,435,694 | A | 7/1995 | Kray | |
| 7,121,803 | B2 | 10/2006 | Gautreau | |
| 7,476,083 | B2 | 1/2009 | Snook | |
| 7,862,300 | B2 | 1/2011 | Nadvit | |
| 9,353,629 | B2 | 5/2016 | Faulder | |
| 2011/0217175 | A1* | 9/2011 | Tochitani | F01D 5/3007 416/193 A |
| 2012/0082564 | A1* | 4/2012 | Ellis | F01D 5/081 29/889.721 |
| 2013/0034445 | A1 | 2/2013 | Ram | |

(Continued)

FOREIGN PATENT DOCUMENTS

| | | |
|---|---|---|
| CA | 2566527 A1 | 5/2005 |
| CN | 104136719 A | 11/2014 |

(Continued)

*Primary Examiner* — Elton K Wong
(74) *Attorney, Agent, or Firm* — Harvest IP Law, LLP

(57) ABSTRACT

Disclosed herein are a grooved turbine blade, and a turbine and a gas turbine including the same. According to the disclosure, since a groove part is formed on a root member to disperse torsional stress, it is possible to improve durability of a rotor disk to which the turbine blade is assembled.

16 Claims, 6 Drawing Sheets

(56) References Cited

U.S. PATENT DOCUMENTS

| | | | | |
|---|---|---|---|---|
| 2015/0110635 | A1* | 4/2015 | Kain | F01D 5/3007 416/221 |
| 2017/0241292 | A1 | 8/2017 | Perez | |

FOREIGN PATENT DOCUMENTS

| | | | |
|---|---|---|---|
| EP | 1355044 | A2 | 10/2003 |
| GB | 2380770 | A | 4/2003 |
| JP | H11141305 | A | 5/1999 |
| JP | 2000-512707 | A | 9/2000 |
| JP | 2008069781 | A | 3/2008 |
| JP | 2017-057851 | A | 3/2017 |
| KR | 100787010 | B1 | 12/2007 |
| KR | 1020150002710 | A | 1/2015 |
| WO | 2020239490 | A1 | 12/2020 |

* cited by examiner

TURBINE BLADE, AND TURBINE AND GAS TURBINE INCLUDING THE SAME

CROSS-REFERENCE TO RELATED APPLICATION

This application claims priority to Korean Patent Application No. 10-2021-0169167, filed on Nov. 30, 2021 the disclosure of which is incorporated herein by reference in its entirety.

BACKGROUND

Technical Field

Exemplary embodiments relate to a turbine blade, and a turbine and a gas turbine including the same, and more particularly, to a grooved turbine blade, and a turbine and a gas turbine including the same.

Related Art

Turbines are machines that obtain a rotational force by impingement or reaction force using the flow of a compressible fluid such as steam or gas. Types of turbines include a steam turbine using steam, a gas turbine using hot combustion gas, and so on.

Among them, the gas turbine generally includes a compressor, a combustor, and turbine. The compressor has an air inlet for introduction of air thereinto, and includes a plurality of compressor vanes and compressor blades alternately arranged in a compressor casing.

The combustor supplies fuel to air compressed by the compressor and ignites a mixture thereof with a burner to produce high-temperature and high-pressure combustion gas.

The turbine includes a plurality of turbine vanes and turbine blades alternately arranged in a turbine casing. In addition, a rotor is disposed to pass through the centers of the compressor, the combustor, the turbine, and an exhaust chamber.

The rotor is rotatably supported at both ends thereof by bearings. The rotor has a plurality of disks fixed thereto, and blades are connected to each of the disks while a drive shaft of, for example, a generator, is connected to the end of the exhaust chamber.

The gas turbine is advantageous in that consumption of lubricant is extremely low due to the absence of mutual friction parts such as a piston-cylinder since it does not have a reciprocating motion of a piston in a four-stroke engine. The amplitude, which is a characteristic of reciprocating machines, is greatly reduced, which enables a turbine of high-speed motion.

The operation of the gas turbine is briefly described. The air compressed by the compressor is mixed with fuel so that the mixture thereof is burned to produce hot combustion gas, and the produced combustion gas is injected into the turbine. The injected combustion gas generates a rotational force while passing through the turbine vanes and the turbine blades, thereby rotating the rotor.

SUMMARY

Aspects of one or more exemplary embodiments provide a turbine blade with improved durability by dispersing stress, and a turbine and a gas turbine including the same.

Additional aspects will be set forth in part in the description which follows and, in part, will become apparent from the description, or may be learned by practice of the exemplary embodiments.

According to an aspect of an exemplary embodiment, there is provided a turbine blade that includes an airfoil, a platform, a root member, a dovetail, and a groove part. The airfoil has an airfoil cross-section and extends radially. The platform is disposed radially inward from the airfoil. The root member is disposed radially inward from the platform and has a decreased width as it is directed radially inward. The dovetail consists of a plurality of dovetails formed on both circumferential sides of the root member and each having a contact surface formed on a radially outer surface thereof. The plurality of dovetails are arranged radially in sequence. The groove part is formed on at least one axial side of the root member. The groove part is recessed inwardly of the root member and extends circumferentially therein. The groove part is formed at a height corresponding to a radially outermost dovetail in the root member, and includes a planar portion having a flat surface formed in at least a portion thereof.

The groove part may be recessed from a bottom of the platform.

The groove part may have a deepest recessed portion into the root member located at a height corresponding to the contact surface.

The groove part may be formed such that an area occupied by the planar portion in the root member at least partially overlaps an area corresponding to the contact surface.

The groove parts may be formed asymmetrically on both axial sides of the root member.

The planar portion may be formed perpendicular to an axial direction of the turbine.

The groove part may further include a first section, a second section, and a third section arranged radially inwardly in sequence. The first section may be recessed inwardly of the root member while being downwardly inclined with respect to an axial direction of the turbine. The second section may be the planar portion. The third section may be recessed inwardly of the root member while being upwardly inclined with respect to the axial direction of the turbine.

The first section, the second section, and the third section may be formed continuously.

The first section or the third section may have a curved cross-section.

The third section may extend further radially inward than the radially outermost dovetail.

According to an aspect of another exemplary embodiment, there is provided a turbine that includes a turbine rotor disk, a turbine blade, and a turbine vane. The turbine rotor disk is rotatable. The turbine blade consists of a plurality of turbine blades arranged on the turbine rotor disk. The turbine blade consists of a plurality of fixed turbine vanes. The turbine blade includes an airfoil, a platform, a root member, a dovetail, and a groove part. The airfoil has an airfoil cross-section and extends radially. The platform is disposed radially inward from the airfoil. The root member is disposed radially inward from the platform and has a decreased width as it is directed radially inward. The dovetail consists of a plurality of dovetails formed on both circumferential sides of the root member and each having a contact surface formed on a radially outer surface thereof. The dovetails are arranged radially in sequence. The groove part is formed on at least one axial side of the root member. The groove part is recessed inwardly of the root member and extends circumferentially therein. The groove part is formed at a height corresponding to a radially outermost dovetail in the root member, and includes a planar portion having a flat surface formed in at least a portion thereof.

The groove part may be formed such that an area occupied by the planar portion in the root member at least partially overlaps an area corresponding to the contact surface.

The groove part may further include a first section, a second section, and a third section arranged radially inwardly in sequence. The first section may be recessed inwardly of the root member while being downwardly inclined with respect to an axial direction of the turbine. The second section may be the planar portion. The third section may be recessed inwardly of the root member while being upwardly inclined with respect to the axial direction of the turbine.

The first section or the third section may have a curved cross-section.

The third section may extend further radially inward than the radially outermost dovetail.

According to an aspect of a further exemplary embodiment, there is provided a gas turbine that includes a compressor, a combustor, and a turbine. The compressor is configured to compress air. The combustor is configured to mix fuel with the air compressed by the compressor to burn a mixture thereof. The turbine includes a turbine vane and a turbine blade. The turbine vane is fixed to guide combustion gas produced by the combustor. The turbine blade is rotated by the combustion gas. The turbine blade includes an airfoil, a platform, a root member, a dovetail, and a groove part. The airfoil has an airfoil cross-section and extends radially. The platform is disposed radially inward from the airfoil. The root member is disposed radially inward from the platform and has a decreased width as it is directed radially inward. The dovetail consists of a plurality of dovetails formed on both circumferential sides of the root member and each having a contact surface formed on a radially outer surface thereof. The plurality of dovetails are arranged radially in sequence. The groove part is formed on at least one axial side of the root member. The groove part is recessed inwardly of the root member and extends circumferentially therein. The groove part is formed at a height corresponding to a radially outermost dovetail in the root member, and includes a planar portion having a flat surface formed in at least a portion thereof.

The groove part may be formed such that an area occupied by the planar portion in the root member at least partially overlaps an area corresponding to the contact surface.

The groove part may further include a first section, a second section, and a third section arranged radially inwardly in sequence. The first section may be recessed inwardly of the root member while being downwardly inclined with respect to an axial direction of the turbine. The second section may be the planar portion. The third section may be recessed inwardly of the root member while being upwardly inclined with respect to the axial direction of the turbine.

The first section or the third section may have a curved cross-section.

The third section may extend further radially inward than the radially outermost dovetail.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
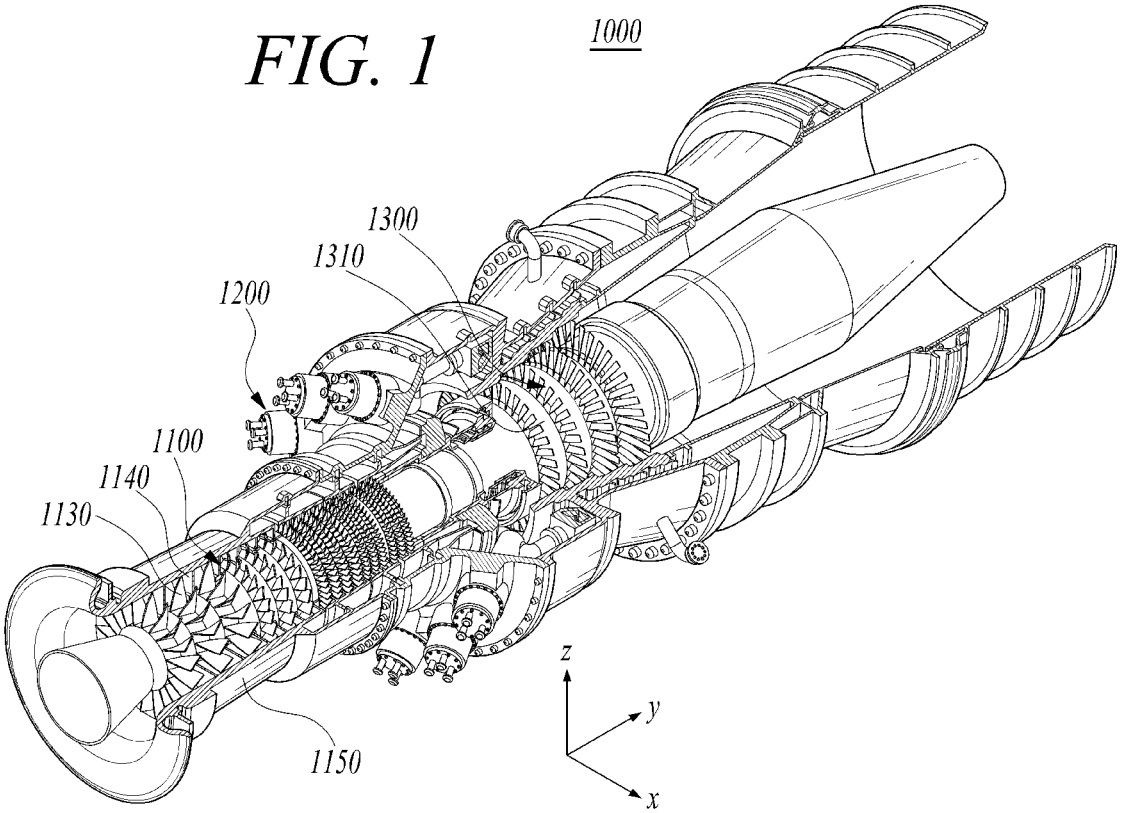
FIG. 1 is a partial cutaway perspective view illustrating a gas turbine according to exemplary embodiments.

Various modifications and different embodiments will be described below in detail with reference to the accompanying drawings so that those skilled in the art can easily carry out the disclosure. It should be understood, however, that the present disclosure is not intended to be limited to the specific embodiments, but the present disclosure includes all modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Hereinafter, a turbine blade, and a turbine and a gas turbine including the same according to exemplary embodiments will be described in detail with reference to the accompanying drawings.

Figure 2:
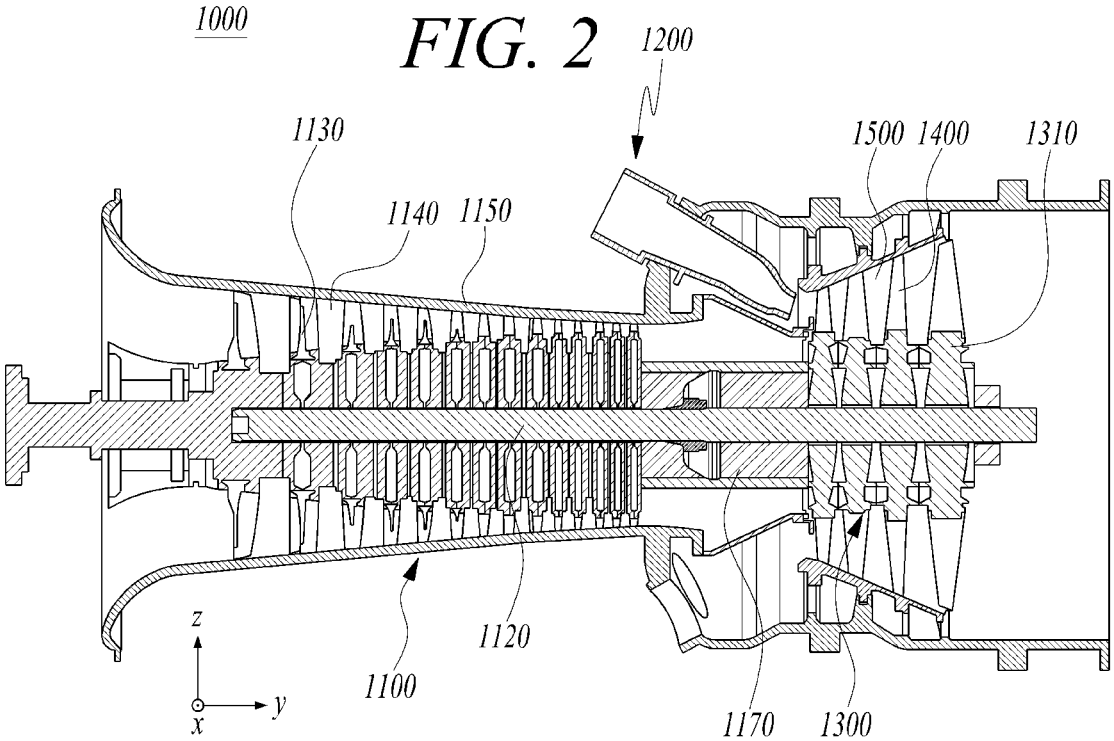
FIG. 2 is a partial cross-sectional view of the gas turbine illustrated in FIG. 1.

FIG. 1 is a partial cutaway perspective view illustrating a gas turbine according to exemplary embodiments. FIG. 2 is a partial cross-sectional view of the gas turbine illustrated in FIG. 1.

Referring to FIGS. 1 and 2, the thermodynamic cycle of the gas turbine, which is designated by reference numeral 1000, according to the exemplary embodiment may ideally follow a Brayton cycle. The Brayton cycle may consist of four phases including isentropic compression (adiabatic compression), isobaric heat addition, isentropic expansion (adiabatic expansion), and isobaric heat dissipation. In other words, in the Brayton cycle, thermal energy may be released by combustion of fuel in an isobaric environment after the atmospheric air is sucked in and compressed to high pressure air, hot combustion gas may be expanded to be converted into kinetic energy, and exhaust gas with residual energy may then be discharged to the atmosphere. The Brayton cycle may consist of four processes, i.e., compression, heating, expansion, and exhaust.

The gas turbine 1000 using the above Brayton cycle may include a compressor 1100, a combustor 1200, and a turbine 1300, as illustrated in FIG. 1. Although the following description is given with reference to FIG. 1, the present disclosure may be widely applied to any turbine engine having the same configuration as the gas turbine 1000 exemplarily illustrated in FIG. 1.

Referring to FIGS. 1 and 2, the compressor 1100 of the gas turbine 1000 may suck in air from the outside and compress the air. The compressor 1100 may supply the combustor 1200 with the air compressed by compressor blades 1130, and may supply cooling air to a hot region required for cooling in the gas turbine 1000. In this case, since the air sucked into the compressor 1100 is subject to an adiabatic compression process therein, the pressure and temperature of the air that has passed through the compressor 1100 increase.

The compressor 1100 is designed as a centrifugal compressor or an axial compressor. In general, the centrifugal compressor is applied to a small gas turbine, whereas the multistage axial compressor 1100 is applied to the large gas turbine 1000 as illustrated in FIG. 1 because it is necessary to compress a large amount of air. In the multistage axial compressor 1100, the blades 1130 of the compressor 1100 rotate along with the rotation of rotor disks with a center tie rod 1120 to compress air introduced thereinto while delivering the compressed air to rear-stage compressor vanes 1140. The air is compressed increasingly to high pressure air while passing through the compressor blades 1130 formed in a multistage manner.

A plurality of compressor vanes 1140 may be formed in a multistage manner and mounted in a compressor casing 1150. The compressor vanes 1140 guide the compressed air to enable the compressed air to flow from front-stage compressor blades 1130 to rear-stage compressor blades 1130. In an exemplary embodiment, at least some of the plurality of compressor vanes 1140 may be mounted so as to be rotatable within a fixed range for regulating the inflow rate of air or the like.

The compressor 1100 may be driven by some of the power output from the turbine 1300. To this end, the rotary shaft of the compressor 1100 may be directly connected to the rotary shaft of the turbine 1300 by a torque tube 1170, as illustrated in FIG. 2. In the large gas turbine 1000, the compressor 1100 may require almost half of the power generated by the turbine 1300 for driving the compressor 1100.

Meanwhile, the combustor 1200 may mix the compressed air, which is supplied from the outlet of the compressor 1100, with fuel for isobaric combustion to produce combustion gas with high energy. The combustor 1200 mixes fuel with the compressed air introduced thereinto and burns a mixture thereof to produce high-temperature and high-pressure combustion gas with high energy. The combustor 1200 increases the temperature of the combustion gas to a heat-resistant limit of combustor and turbine components through an isobaric combustion process.

The combustor 1200 may consist of a plurality of combustors arranged in a combustor casing in the form of a shell. Each of the combustors includes a burner having a fuel injection nozzle and the like, a combustor liner defining a combustion chamber, and a transition piece serving as the connection between the combustor and the turbine.

The high-temperature and high-pressure combustion gas coming out of the combustor 1200 is supplied to the turbine 1300. The high-temperature and high-pressure combustion gas supplied to the turbine 1300 applies impingement or reaction force to turbine blades 1400 while expanding, which results in rotational torque. The resultant rotational torque is transmitted to the compressor 1100 via the torque tube 1170, and power exceeding the power required to drive the compressor 1100 is used to drive a generator or the like.

The turbine 1300 includes rotor disks 1310, a turbine casing 1800, a plurality of turbine blades 1400 radially arranged on each of the rotor disks 1310, a plurality of turbine vanes 1500, and a plurality of ring segments 1600 surrounding the turbine blades 1400.

The turbine blades 1400 are inserted into each of the rotor disks 1310, and the turbine vanes 1500 are mounted in the turbine casing 1800. The turbine casing 1800 is formed of a frustoconical tube, and the turbine blades 1400, the vanes 1500, and the ring segments 1600 are accommodated in the turbine casing 1800.

The turbine vanes 1500 are fixed so as not to rotate and serve to guide a direction of flow of the combustion gas that has passed through the turbine blades 1400.

Figure 3:
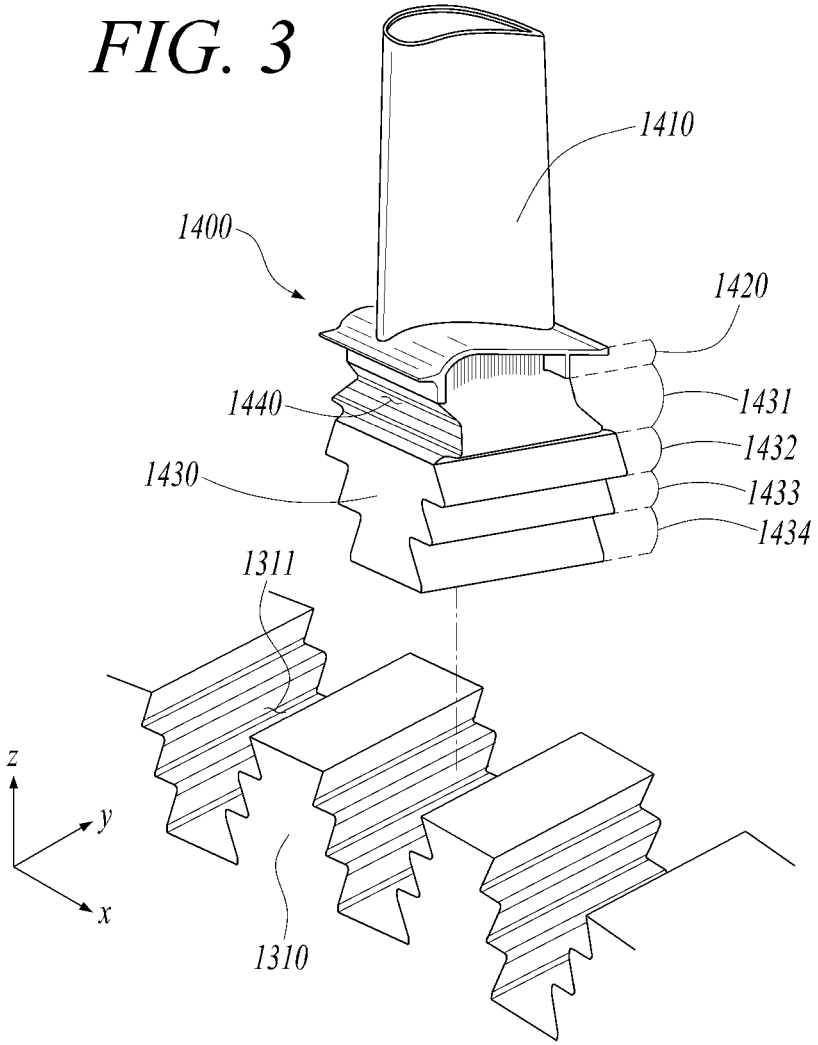
FIG. 3 is a perspective view illustrating a turbine blade and a portion of a rotor disk according to a first exemplary embodiment.
Figure 4:
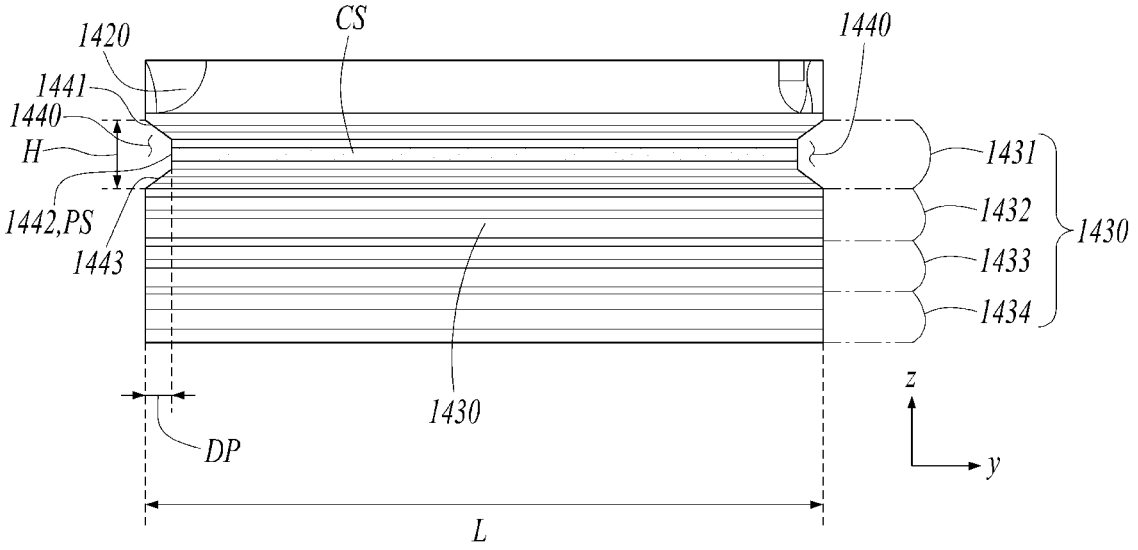
FIG. 4 is a partial side view of the turbine blade illustrated in FIG. 3 as viewed in a circumferential direction with respect to a rotational axis of the gas turbine according to the first exemplary embodiment.
Figure 5:
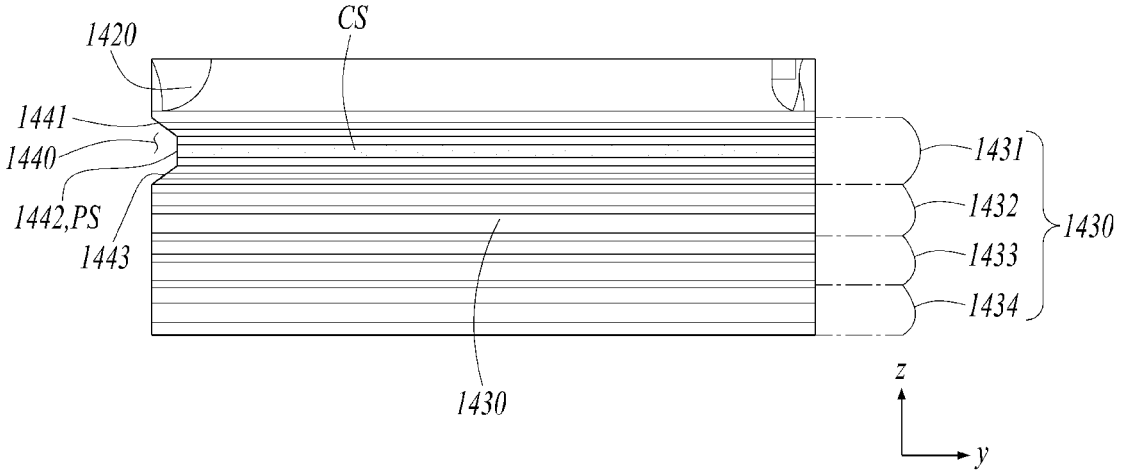
FIG. 5 is a partial side view illustrating that a groove part is formed on only one axial side of a root member shown in FIG. 4 according to the first exemplary embodiment.
Figure 6:
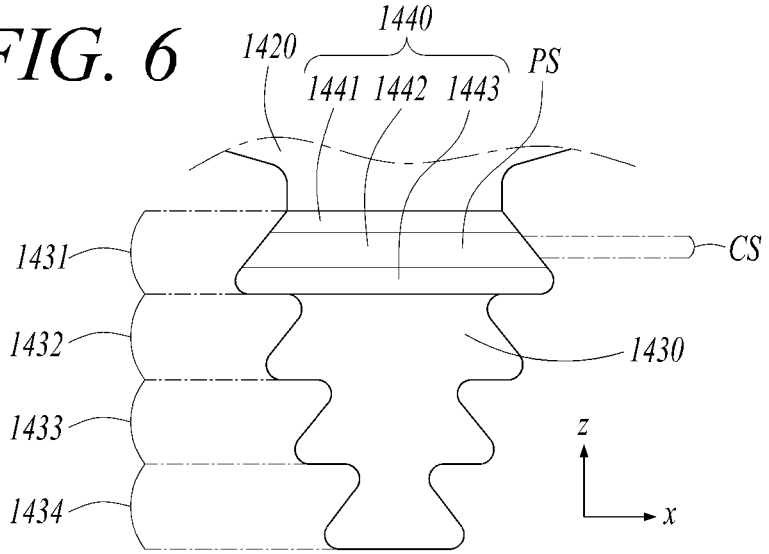
FIG. 6 is a side view of the turbine blade illustrated in FIG. 3 as viewed in an axial direction with respect to the rotational axis of the gas turbine according to the first exemplary embodiment.

FIG. 3 is a perspective view illustrating a turbine blade and a portion of a rotor disk according to a first exemplary embodiment. FIG. 4 is a side view of the turbine blade illustrated in FIG. 3 as viewed in a circumferential direction with respect to a rotational axis of the gas turbine according to the first exemplary embodiment. FIG. 5 is a side view illustrating that a groove part is formed on only one axial side of a root member shown in FIG. 4 according to the first exemplary embodiment. FIG. 6 is a side view of the turbine blade illustrated in FIG. 3 as viewed in an axial direction with respect to the rotational axis of the gas turbine according to the first exemplary embodiment.

Hereinafter, the turbine blade, which is designated by reference numeral 1400, according to the first exemplary embodiment will be described in detail with reference to FIGS. 3 to 6. The turbine blade 1400 according to the first exemplary embodiment includes an airfoil 1410, a platform 1420, and a root member 1430.

The airfoil 1410 is located radially outwardly of the turbine in the turbine blade 1400. Here, the radial direction of the turbine refers to a direction extending from a centerline of the turbine outward toward the casing, which is hereinafter referred to as a radial direction (z-direction). The airfoil 1410 has an airfoil cross-section, and extends radially (z-direction) outwardly of the turbine. The airfoil 1410 has a leading edge (not shown) and a trailing edge (not shown) formed thereon. The leading edge is formed upstream in the direction of flow of combustion gas. The trailing edge is formed downstream in the direction of flow of combustion gas.

The platform 1420 is disposed radially (z-direction) inwardly from the airfoil 1410. The platform 1420 may have a substantially square plate shape. The airfoil 1410 may have a cooling passage (not shown) formed therein so that a cooling fluid flows in the cooling passage. The cooling passage may pass through the platform 1420.

The root member 1430 is disposed radially (z-direction) inwardly from the platform 1420. The root member 1430 has a decreased width as it is directed radially (z-direction) inward. Here, the width of the root member 1430 means a width in a circumferential direction. The circumferential direction refers to a direction of rotation about the centerline of the turbine, and, hereinafter, is referred to as a circumferential direction (x-direction). Note that, in FIGS. 1 to 9, although the x-direction is represented as a vector perpendicular to both y-direction (axial) and z-direction (radial) for the sake of simplicity, the x-direction should be understood as the direction of rotation about the centerline of the turbine.

The root member 1430 has a dovetail 1431/1432/1433/1434 formed on both circumferential sides thereof. Here, a circumferential side corresponds to a plane which is formed by an intersection of z-direction (radial) and y-direction (axial). The dovetail 1431/1432/1433/1434 may have a fir-tree shape in cross section. The dovetail 1431/1432/1433/1434 may consist of a plurality of dovetails. In this case, the dovetail 1431/1432/1433/1434 may include a first dovetail 1431, a second dovetail 1432, a third dovetail 1433, and a fourth dovetail 1434, which are disposed radially (z-direction) inwardly in sequence. A circumferential width of the dovetail 1431/1432/1433/1434 may gradually decrease from the first dovetail 1431 to the fourth dovetail 1434 as shown in FIG. 6. Although the dovetail 1431/1432/1433/1434 has been described as consisting of four dovetails from the first dovetail 1431 to the fourth dovetail 1434 herein, the number of dovetails is not limited thereto. For example, fewer or more dovetails may be provided.

The above-mentioned rotor disk 1310 has a substantially disk shape. The rotor disk 1310 has a plurality of grooves 1311 formed on an outer peripheral portion thereof. Each of the grooves 1311 has a curved surface, and the turbine blade 1400 is inserted into the associated groove 1311 for coupling therewith. Specifically, the root member 1430 of the turbine blade 1400 is inserted into the groove 1311 of the rotor disk 1310. The dovetail 1431/1432/1433/1434 of the root member 1430 is inserted into the groove 1311 of the rotor disk 1310 for engagement therewith. To this end, the groove 1311 of the rotor disk 1310 has a cross-sectional shape corresponding to the dovetail 1431/1432/1433/1434 of the root member 1430.

When the rotor disk 1310 rotates, a centrifugal force acts radially (z-direction) outward on the root member 1430 inserted into the groove 1311. Accordingly, the dovetail 1431/1432/1433/1434 has a contact surface CS that is in close contact with the groove of the rotor disk 1310. Since the centrifugal force acting on the root member 1430 is directed radially (z-direction) outward, the contact surface CS is formed on the radially (z-direction) outer surface of each of the dovetail 1431/1432/1433/1434. The contact surface CS is illustrated as being formed only on the first dovetail 1431 in the accompanying drawings, but this is only for convenience of description. That is, the contact surface CS is also formed on each of the second to fourth dovetails 1432 to 1434. Hereinafter, the contact surface CS refers to the contact surface CS of the first dovetail 1431.

A groove part 1440 is formed on at least one side of the root member 1430 in axial sides of the turbine. Here, an axial side corresponds to a plane which is formed by an intersection of z-direction (radial) and x-direction (circumferential). In addition, an axial direction of the turbine which corresponds to an inflow direction is referred to as an axial direction (y-direction). The groove part 1440 is recessed inwardly of the root member 1430. The groove part 1440 extends circumferentially (x-direction) in the root member 1430.

The groove part 1440 may be formed only on one axial side of the root member 1430 as illustrated in FIG. 5. Alternatively, the groove parts 1440 may be formed on both axial sides of the root member 1430 as illustrated in FIG. 4. When the groove parts 1440 are formed on both axial sides of the root member 1430, the groove parts 1440 may be symmetrical or asymmetrical to each other which will be described later.

Each groove part 1440 may be formed at a height corresponding to the dovetail 1431/1432/1433/1434 disposed at the radially (z-direction) outermost portion in the root member 1430. That is, the groove part 1440 may be formed at a height corresponding to the first dovetail 1431.

As combustion gas flows through the airfoil 1410, the turbine blade 1400 develops torsional stress. Since the root member 1430 of the turbine blade 1400 is coupled to the rotor disk 1310, the torsional stress also acts on the dovetail 1431/1432/1433/1434 of the root member 1430 and the rotor disk 1310. In this case, the torsional stress is most concentrated on the first dovetail 1431 because the first dovetail 1431 of the dovetail 1431/1432/1433/1434 coupled to the rotor disk is located closest to the airfoil 1410. The formation of the groove part 1440 at a height corresponding to the first dovetail 1431 may disperse the torsional stress.

The result of analysis of the torsional stress acting on the rotor disk 1310 showed that, when the root member 1430 without groove part 1440 is assembled to the rotor disk 1310, the stress acting on the leading edge was measured to be 1522 MPa and the stress acting on the trailing edge was measured to be 1632 MPa. On the other hand, the result showed that, when the root member 1430 with the groove part 1440 is assembled to the rotor disk 1310, the stress acting on the leading edge is 1202 MPa and the stress acting on the trailing edge was measured to be 1302 MPa.

That is, it can be seen that the stress acting on the rotor disk 1310 to which the root member 1430 with the groove part 1440 is assembled was reduced by 21.0% on the leading edge and by 20.2% on the trailing edge than the stress acting on the rotor disk 1310 to which the root member 1430 with no groove part 1440 is assembled.

Meanwhile, in order to form the groove part 1440 on the portion closest to the airfoil 1410 in the root member 1430, the groove part 1440 may be recessed from the bottom of the platform 1420.

More specifically, the torsional stress is most concentrated on the contact surface CS of the first dovetail 1431 that is in close contact with the rotor disk 1310. In order to minimize the concentration of the torsional stress, the groove part 1440 may have an innermost recessed portion in the root member 1430, which is located at a height corresponding to the contact surface CS.

However, when the groove part 1440 has an excessively recessed depth into the root member 1430, the rigidity of the root member 1430 may be reduced. Accordingly, the groove part 1440 should be recessed to a degree capable of maintaining the rigidity of the root member 1430 while dispersing the torsional stress. According to a result of experiment and analysis, when an axial (y-direction) length of the root member 1430 is L and a recessed depth of the groove part 1440 is DP, it was confirmed that the rigidity of the root member 1430 starts decreasing if DP is greater than 1/20 of L. In addition, it was confirmed that the effect of torsional stress dispersion was poor when DP is greater than 1/40 of L. Therefore, the recessed depth of the groove part 1440 may be preferably from 1/20 to 1/40 of the axial (y-direction) length of the root member 1430.

In addition, when a radial (z-direction) width of the groove part 1440 is H, the recessed depth DP of the groove part 1440 may be smaller than H. Preferably, DP may be 1/2 to 2/5 of H. In this way, the effect of torsional stress dispersion can be improved.

At least a portion of the groove part 1440 is formed as a planar portion PS. The planar portion PS has a flat surface. The planar portion PS has a straight line in cross-section when the groove part 1440 is viewed in the circumferential direction (x-direction).

The planar portion PS may have a cross-section perpendicular to the axial direction (y-direction) when the groove part 1440 is viewed in the circumferential direction (x-direction). In this case, the recessed depth of the groove part 1440 into the root member 1430 in the planar portion PS may be constantly maintained along the radial direction (z-direction).

The planar portion PS may be a deepest recessed portion of the groove part 1440 into the root member 1430. In this case, the dispersion of the torsional stress may be greatest in the planar portion PS.

In addition, the planar portion PS may at least partially overlap an area corresponding to the contact surface CS of the first dovetail 1431. The radially (z-direction) inner portion of the planar portion PS may overlap the area of the contact surface CS, and/or the radially (z-direction) outer portion of the planar portion PS may overlap the area of the contact surface CS. Moreover, the planar portion PS may be included in the area of the contact surface CS. Alternatively, the area of the contact surface CS may be included in the planar portion PS. As described above, the torsional stress may be most concentrated on the contact surface CS. Therefore, when the planar portion PS at least partially overlaps the area corresponding to the contact surface CS, the torsional stress can be effectively dispersed.

The groove part 1440 may further include a first section 1441, a second section 1442, and a third section 1443. The first section 1441, the second section 1442, and the third section 1443 are disposed radially (z-direction) inwardly in sequence in the groove part 1440. The first section 1441 may be recessed inwardly of the root member 1430 while being downwardly inclined or tapered with respect to the axial direction (y-direction), and the third section 1443 may be recessed inwardly of the root member 1430 while being upwardly inclined or tapered with respect to the axial direction (y-direction). The second section 1442 is formed between the first section 1441 and the third section 1443. The second section 1442 may be a deepest recessed portion into the root member 1430, rather than the first and third sections 1441 and 1443. Accordingly, the second section 1442 may be located at a height corresponding to the contact surface CS of the first dovetail 1431, and may be the above-mentioned planar portion PS.

The first section 1441, the second section 1442, and the third section 1443 may be formed continuously. That is, the first to third sections 1441 to 1443 may have a continuous cross-section when the groove part 1440 is viewed in the circumferential direction (x-direction). When the first section and third sections 1441 and 1443 each has a straight line in cross-section as viewed in the circumferential direction (x-direction), the groove part 1440 has a substantially trapezoidal shape with no underside in cross section as viewed in the circumferential direction (x-direction). The reason for forming the sections in continuous manner is that, when the first section 1441, the second section 1442, and the third section 1443 are formed discontinuously, stress or load may be concentrated on the discontinuous portion between the sections.

Figure 7:
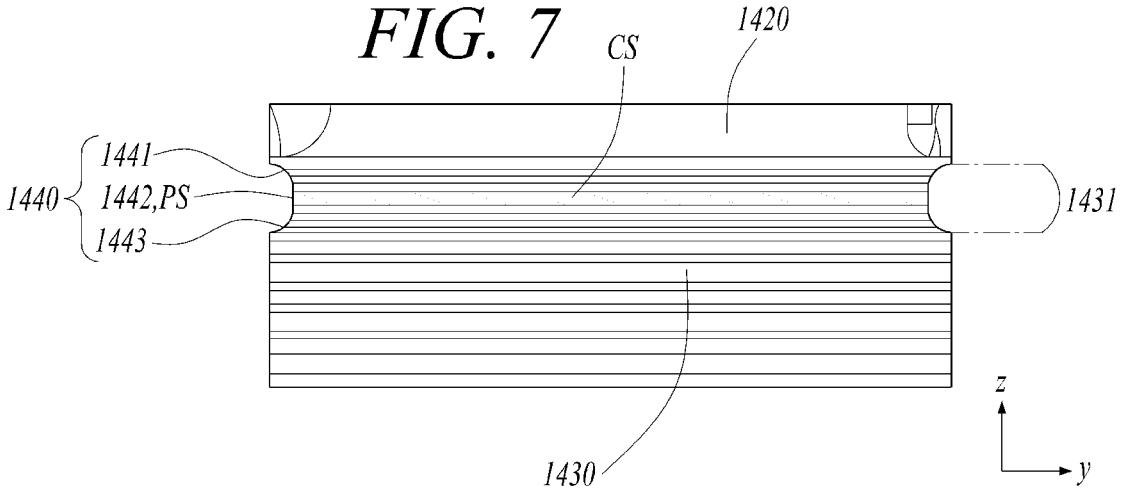
FIG. 7 is a partial side view of a turbine blade as viewed in the circumferential direction with respect to the rotational axis of the gas turbine according to a second exemplary embodiment.

FIG. 7 is a partial side view of a turbine blade as viewed in the circumferential direction with respect to the rotational axis of the gas turbine according to a second exemplary embodiment.

Hereinafter, the turbine blade, which is designated by reference numeral 1400, according to the second exemplary embodiment will be described in detail with reference to FIG. 7. Since the turbine blade 1400 according to the second exemplary embodiment is the same as the turbine blade 1400 according to the first exemplary embodiment except for a groove part 1440, a redundant description thereof will be omitted.

The groove part 1440 of the turbine blade 1400 according to the second exemplary embodiment includes a first section 1441, a second section 1442, and a third section 1443. The first section 1441 or the third section 1443 has a curved cross-section. Preferably, the cross-section of the first or third section 1441 or 1443 may form a concave shape while being recessed from a surface the root member 1430 in the axial direction as shown in FIG. 7 or a convex shape (not shown) while being recessed from the surface the root member 1430 in the axial direction. The first section 1441 and the third section 1443 may be symmetrical with respect to the second section 1442. The first section 1441, the second section 1442, and the third section 1443 may be formed continuously. In this case, the groove part 1440 may have a substantially arched shape in cross-section as viewed in the circumferential direction (x-direction). The reason for forming the arched cross-sectional shape is that the torsional stress and the like can be more effectively dispersed.

Figure 8:
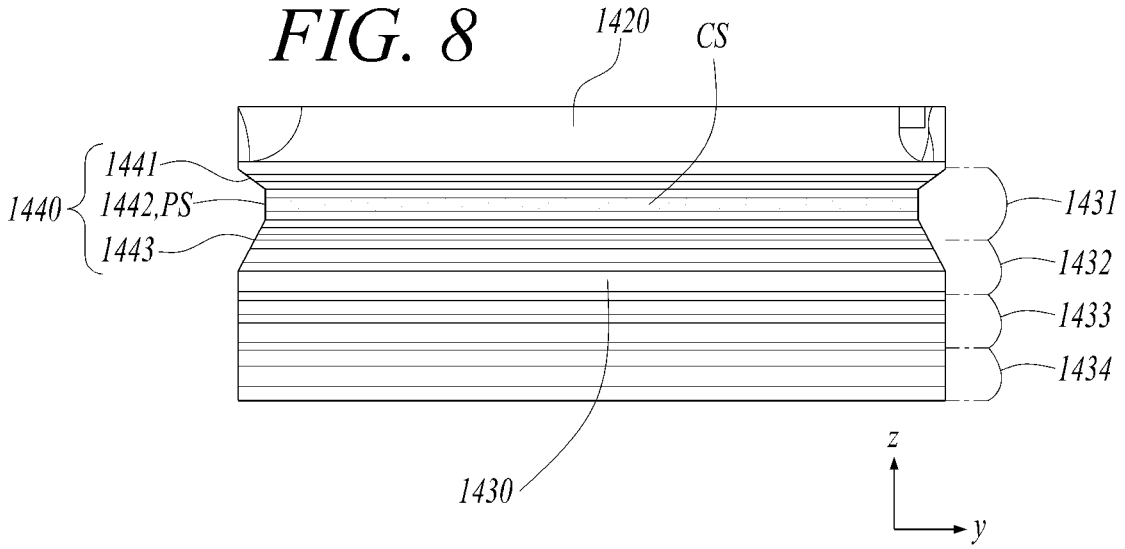
FIG. 8 is a partial side view of a turbine blade as viewed in the circumferential direction with respect to the rotational axis of the gas turbine according to a third exemplary embodiment.

FIG. 8 is a partial side view of a turbine blade as viewed in the circumferential direction with respect to the rotational axis of the gas turbine according to a third exemplary embodiment.

Hereinafter, the turbine blade, which is designated by reference numeral 1400, according to the third exemplary embodiment will be described in detail with reference to FIG. 8. Since the turbine blade 1400 according to the third exemplary embodiment is the same as the turbine blade 1400 according to the first exemplary embodiment except for a groove part 1440, a redundant description thereof will be omitted.

The groove part 1440 of the turbine blade 1400 according to the third exemplary embodiment includes a first section 1441, a second section 1442, and a third section 1443. The third section 1443 extends further radially (z-direction) inward than the radially (z-direction) outermost dovetail 1431/1432/1433/1434. Specifically, the turbine blade 1400 according to the first or second exemplary embodiment is configured such that the groove part 1440 is formed only at a height corresponding to the first dovetail 1431, whereas the turbine blade 1400 according to the third exemplary embodiment is configured such that the groove part 1440 extends to any dovetail 1432, 1433, or 1434 other than the first dovetail 1431. In this case, the second section 1442, which is a deepest recessed portion, of the groove part 1440 may be disposed at a height corresponding to the contact surface CS of the first dovetail 1431, and the third section 1443 disposed radially (z-direction) inwardly from the second section 1442 extends to a height corresponding to one of the second dovetail 1432, the third dovetail 1433, and the fourth dovetail 1434. For example, the third section 1443 extends to an area corresponding to the second dovetail 1432 in FIG. 8.

Figure 9:
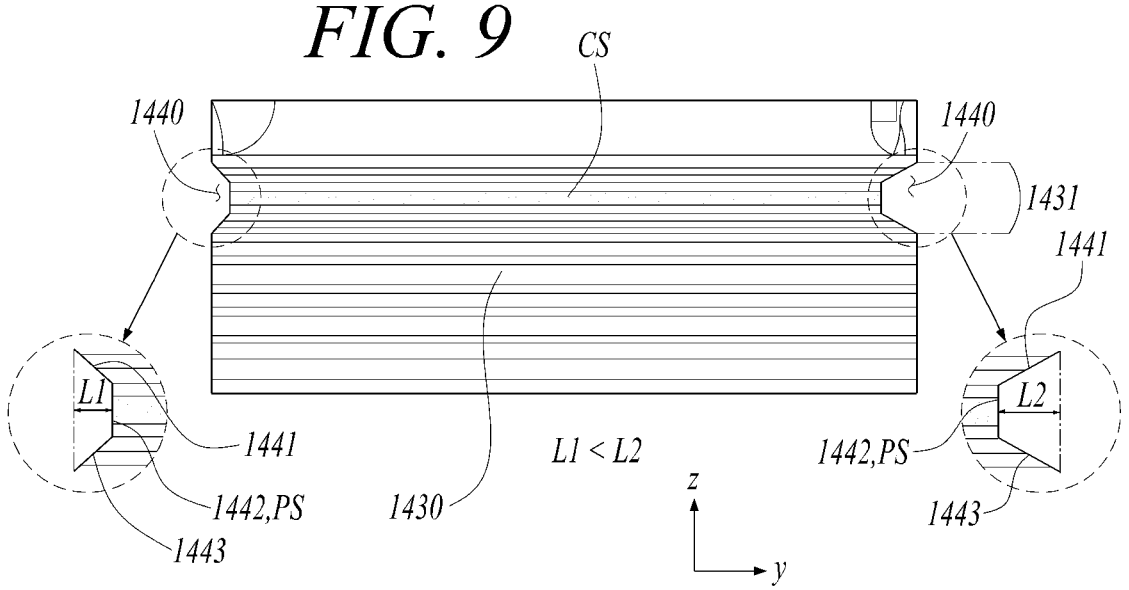
FIG. 9 is a partial side view of a turbine blade as viewed in the circumferential direction with respect to the rotational axis of the gas turbine according to a fourth exemplary embodiment.

FIG. 9 is a partial side view of a turbine blade as viewed in the circumferential direction with respect to the rotational axis of the gas turbine according to a fourth exemplary embodiment.

Hereinafter, the turbine blade, which is designated by reference numeral 1400, according to the fourth exemplary embodiment will be described in detail with reference to FIG. 9. Since the turbine blade 1400 according to the fourth exemplary embodiment is the same as the turbine blade 1400 according to the first exemplary embodiment except for a groove part 1440, a redundant description thereof will be omitted.

The groove parts 1440 of the turbine blade 1400 according to the fourth exemplary embodiment may be formed asymmetrically on both axial sides of the root member 1430. For example, the groove part 1440 on one axial side of the root member 1430 is recessed to a first depth DP1, and the groove part 1440 on the other side opposite to the one axial side is recessed to a second depth DP2 that is different from the first depth DP1.

In this case, one side of the root member 1430 may be a portion close to the leading edge of the airfoil 1410, and the other side may be a portion close to the trailing edge of the airfoil 1410. As described above, the leading edge is formed upstream in the direction of flow of combustion gas, and the trailing edge is formed downstream in the direction of flow of combustion gas. Therefore, the torsional stresses, which act on one side and the other side of the root member 1430, respectively, may have different magnitudes. In this case, when the first depth DP1 at the one side is different from the second depth DP2 at the other side, the torsional stress can be more effectively dispersed. For example, as illustrated in FIG. 9, the first depth DP1 at one side of the root member 1430 may be smaller than the second depth DP2 at the other side. However, FIG. 9 is only an example. Therefore, alternatively, the first depth DP1 may be larger than the second depth DP2.

Moreover, as in the turbine blade 1400 according to the third exemplary embodiment, the third section 1443 of one of the groove parts 1440 formed on one side and the other side of the root member 1430 may extend further radially (z-direction) inward than the third section 1443 of the other groove part 1440.

As is apparent from the above description, in the turbine blade, and the turbine and the gas turbine including the same according to the exemplary embodiments, the durability of the rotor disk to which the turbine blade is assembled can be improved as the groove part is formed on the root member to disperse torsional stress.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A turbine blade comprising:

an airfoil having an airfoil cross-section and extending radially;

a platform disposed radially inward from the airfoil;

a root member disposed radially inward from the platform and having a decreased width as the root member is directed radially inward;

a plurality of dovetails formed on both circumferential sides of the root member and each having a contact surface formed on a radially outer surface thereof, the plurality of dovetails being arranged radially in sequence; and a groove part formed on at least one axial side of the root member, the groove part being recessed from a surface of the root member in an axial direction and extending circumferentially therein, wherein the groove part is formed at a height corresponding to a radially outermost dovetail in the root member, and comprises a planar portion having a flat surface formed in at least a portion thereof, wherein the groove part further comprises a first section, a second section, and a third section arranged radially inwardly in sequence and formed continuously in sequence, the first section being recessed and inclined from the surface of the root member in the axial direction and connected to the surface of the root member, the second section being the planar portion, and the third section being recessed and inclined from the surface of the root member in the axial direction and connected to the surface of the root member, wherein all of the first, second and third sections are formed within a range of the height correspondingly to the radially outermost dovetail in the root member.

2. The turbine blade according to claim 1, wherein the groove part is recessed from a bottom of the platform.

3. The turbine blade according to claim 1, wherein the groove part has a deepest recessed portion into the root member located at a height corresponding to the contact surface of the radially outermost dovetail.

4. The turbine blade according to claim 1, wherein the groove part is formed such that an area occupied by the planar portion in the root member at least partially overlaps an area corresponding to the contact surface of the radially outermost dovetail.

5. The turbine blade according to claim 1, wherein the groove parts are formed asymmetrically on both axial sides of the root member.

6. The turbine blade according to claim 1, wherein the planar portion is formed perpendicular to the axial direction.

7. The turbine blade according to claim 1, wherein the first section or the third section has a curved cross-section.

8. The turbine blade according to claim 1, wherein a radial outer end of the first section corresponds to a position where a circumferential diameter of the radially outermost dovetail starts to gradually increase radially inwardly.

9. The turbine blade according to claim 1, wherein a recessed depth of the groove part in the axial direction is from 1/20 to 1/40 of an axial length of the root member.

10. The turbine blade according to claim 1, wherein a recessed depth of the groove part in the axial direction is from 1/2 to 2/5 of a radial length of the groove part.

11. A turbine comprising:

a rotatable turbine rotor disk;

a plurality of turbine blades arranged on the turbine rotor disk; and a plurality of fixed turbine vanes, wherein each of the turbine blades comprises:

an airfoil having an airfoil cross-section and extending radially;

a platform disposed radially inward from the airfoil;

a root member disposed radially inward from the platform and having a decreased width as the root member is directed radially inward;

a plurality of dovetails formed on both circumferential sides of the root member and each having a contact surface formed on a radially outer surface thereof, the plurality of dovetails being arranged radially in sequence; and a groove part formed on at least one axial side of the root member, the groove part being recessed from a surface of the root member in an axial direction and extending circumferentially therein, and wherein the groove part is formed at a height corresponding to a radially outermost dovetail in the root member, and comprises a planar portion having a flat surface formed in at least a portion thereof, wherein the groove part further comprises a first section, a second section, and a third section arranged radially inwardly in sequence and formed continuously in sequence, the first section being recessed and inclined from the surface of the root member the axial direction and connected to the surface of the root member, the second section being the planar portion, and the third section being recessed and inclined from the surface of the root member in the axial direction and connected to the surface of the root member, where all of the first, second and third sections are formed within a range of the height corresponding to the radially outermost dovetail in the root member.

12. The turbine according to claim 11, wherein the groove part is formed such that an area occupied by the planar portion in the root member at least partially overlaps an area corresponding to the contact surface of the radially outermost dovetail.

13. The turbine according to claim 11, wherein the first section or the third section has a curved cross-section.

14. A gas turbine comprising:

a compressor configured to compress air;

a combustor configured to mix fuel with the air compressed by the compressor to burn a mixture thereof; and a turbine comprising a turbine vane fixed to guide combustion gas produced by the combustor and a turbine blade rotated by the combustion gas, wherein the turbine blade comprises:

an airfoil having an airfoil cross-section and extending radially;

a platform disposed radially inward from the airfoil;

a root member disposed radially inward from the platform and having a decreased width as the root member is directed radially inward;

a plurality of dovetails formed on both circumferential sides of the root member and each having a contact surface formed on a radially outer surface thereof, the plurality of dovetails being arranged radially in sequence; and a groove part formed on at least one axial side of the root member, the groove part being recessed from a surface of the root member in an axial direction and extending circumferentially therein, and wherein the groove part is formed at a height corresponding to a radially outermost dovetail in the root member, and comprises a planar portion having a flat surface formed in at least a portion thereof, wherein the groove part further comprises a first section, a second section, and a third section arranged radially inwardly in sequence and formed continuously in sequence, the first section being recessed and inclined from the surface of the root member the axial direction and connected to the surface of the root member, the second section being the planar portion, and the third section being recessed and inclined from the surface of the root member in the axial direction and connected to the surface of the root member, where all of the first, second and third sections are formed within a range of the height corresponding to the radially outermost dovetail in the root member.

15. The gas turbine according to claim 14, wherein the groove part is formed such that an area occupied by the planar portion in the root member at least partially overlaps an area corresponding to the contact surface of the outermost dovetail.

16. The gas turbine according to claim 14, wherein the first section or the third section has a curved cross-section.

* * * * *